US006129222A

United States Patent [19]

Mylander et al.

[11] Patent Number: 6,129,222

[45] **Date of Patent: *Oct. 10, 2000**

[54] DISPLAY AND STORAGE SYSTEM

[75] Inventors: Paul H. Mylander, North Attleboro, Mass.; Joan T. Roth, Providence; Mike Banaczuk, Warwick, both of R.I.; Jim Tennant, Braintree, Mass.

[73] Assignee: Intercraft Company, Statesville, N.C.

[ * ] Notice: This patent is subject to a terminal disclaimer.

[21] Appl. No.: 09/320,151

[22] Filed: May 26, 1999

Related U.S. Application Data

[63] Continuation-in-part of application No. 09/236,796, Jan. 25, 1999.

[51] Int. Cl.[7] ..... A47F 5/08

[52] U.S. Cl. ..... 211/106; 211/50; 211/181.1

[58] Field of Search ..... 211/106, 59.2, 211/59.1, 57.1, 181.1, 195, 184, 54.1, 50, 51; D6/566; 206/731, 745, 766

[56] References Cited

U.S. PATENT DOCUMENTS

| | | | |
|---|---|---|---|
| D. 380,638 | 7/1997 | Cohen et al. . | |
| 2,331,361 | 10/1943 | Tuttle et al. . | |
| 2,706,517 | 4/1955 | Dexter et al. . | |
| 2,793,760 | 5/1957 | Zel et al. . | |
| 2,815,854 | 12/1957 | McKenna . | |
| 3,114,459 | 12/1963 | Kersting . | |
| 3,302,797 | 2/1967 | Kolster . | |
| 3,595,404 | 7/1971 | Goldstein . | |
| 3,693,808 | 9/1972 | Rauch | 211/181.1 |
| 3,777,896 | 12/1973 | Ehrlich . | |
| 3,780,873 | 12/1973 | Silva . | |
| 3,880,292 | 4/1975 | Kitchen . | |
| 3,978,799 | 9/1976 | Escalette . | |
| 4,074,451 | 2/1978 | Jacobson et al. . | |
| 4,191,160 | 3/1980 | Elliott | 211/181.1 |
| 4,222,579 | 9/1980 | Frydendal | 211/181.1 |
| 4,248,352 | 2/1981 | White | 211/106 |
| 4,498,592 | 2/1985 | Colucci . | |
| 4,678,086 | 7/1987 | Nervig et al. . | |
| 4,742,923 | 5/1988 | Calvert | 211/59.1 |
| 4,830,200 | 5/1989 | Zambano et al. | 211/181.1 |
| 4,895,334 | 1/1990 | Bajek et al. | 211/106 |
| 4,913,297 | 4/1990 | Wells . | |
| 4,943,029 | 7/1990 | Szuster | 211/181.1 |
| 5,205,208 | 4/1993 | Gongwer | 211/181.1 |
| 5,213,221 | 5/1993 | Raye, Sr. | 211/195 |
| 5,244,104 | 9/1993 | Green et al. | 211/181.1 |
| 5,257,702 | 11/1993 | Grafstein . | |
| 5,397,087 | 3/1995 | Teece | 211/106 |
| 5,435,295 | 7/1995 | Gerrard | 211/181.1 |
| 5,437,379 | 8/1995 | Wolf et al. | 211/47 |
| 5,449,076 | 9/1995 | Van Noord | 211/59.1 |
| 5,553,724 | 9/1996 | Moher et al. . | |
| 5,775,209 | 7/1998 | Tiemann | 211/181.1 |
| 5,806,688 | 9/1998 | Adenau et al. . | |
| 5,810,299 | 9/1998 | Poulos . | |
| 5,815,970 | 10/1998 | Thalenfeld et al. . | |
| 5,823,100 | 10/1998 | Weinhold et al. | 211/181.1 |
| 5,836,459 | 11/1998 | Nezwek et al. . | |

*Primary Examiner*—Daniel P. Stodola
*Assistant Examiner*—Jennifer E. Novosad
*Attorney, Agent, or Firm*—Foley & Lardner

[57] ABSTRACT

A display and storage device includes a first storage portion and a second display portion pivotally and removably secured to the front of the storage portion. The storage portion includes a vertical side and a bottom. The width of the bottom is at least one-half the width of the product to be stored. The display portion is constructed to receive and display a single item to allow a consumer to examine it. Once a buying decision has been made, the display portion is opened relative to the storage portion to permit the consumer to remove one or more fresh, saleable products. Both portions may be made from wire rods. Also included is a system comprising a plurality of the display and storage devices arranged together, so that the side of the storage portion of one device acts as a containment wall for product stored in an adjacent device.

23 Claims, 9 Drawing Sheets

DISPLAY AND STORAGE SYSTEM

CROSS-REFERENCES TO RELATED APPLICATIONS, IF ANY

This application is a continuation-in-part of U.S. patent application Ser. No. 09/236,796 filed Jan. 25, 1999.

BACKGROUND OF THE INVENTION

1. Field of the Invention

The present invention relates generally to the field of displays and more particularly to a storage and display device useful for retail establishments and for products where a customer is likely to examine a product prior to making a purchase decision. Still more specifically, the present invention relates to a display and storage device useful for objects including, but not limited to, photo albums and other consumer goods in which a single one of the items is displayed for the consumer in a display portion and, after a purchase decision is made, the device may be opened to allow the consumer to remove one or more fresh and saleable products from a storage portion. The present invention also relates to a system including a plurality of individual display and storage devices, each made from wire, and each being attached to peg board or slat wall surfaces or other surfaces commonly found in retail establishments. The most preferred form of the individual display and storage device includes a spring biasing element for holding the displayed object in the display portion and also includes a detachable display portion to facilitate shipment of the storage and display devices.

2. Description of the Prior Art

A large variety of display techniques are known, including shelves and peg board with various rods and brackets attached thereto for the display of individual items or groups of items. For the display of photo albums, for example, the most common technique employed today is to merely place a plurality of the items on the shelf for examination and purchase by the customer. These types of products typically invoke a comparison shopping urge in the customer, and typically a plurality of products will be removed from the shelf, examined by the customer and replaced before a final purchase decision is made. Because there are typically numerous sizes, colors, and brands of such products displayed at a store, and since customers typically do not take the time to carefully replace a particular product from the exact location from which it was initially removed, clutter results where product styles may become intermixed and become less attractive to the consumer. Using photo albums as an example, the customer may examine several varieties before making purchase decisions, and then may decide to buy additional refill pages for an album that has been selected. If the albums have become intermixed with albums of other styles or brands, the selection of an appropriate refill also becomes more difficult.

The problems mentioned to this point relate primarily to those encountered by or caused by the customer, but the purchasing habits of customer for these types of products also create problems for the retailer who must rearrange the display and maintain appropriate inventories of both the original product and, in the case of photo albums, refills. These processes become time consuming and expensive.

A display and storage system which allows customers to examine a product and which prevents the product intermingling discussed above, and which further provides for orderly and simplified inventory management for the retailer would represent a very substantial advance in this field of invention.

FEATURES AND SUMMARY OF THE INVENTION

A primary feature of the present invention is to provide a display and storage system which overcomes the above-noted disadvantage of existing display systems.

Another feature of the present invention is to provide a display and storage system which may be adapted to a wide variety of products of different sizes.

A further feature of the present invention is to provide a display and storage system which may comprise a plurality of individual display and storage devices, allowing the system to be adapted to a variety of space requirements and which may be arranged in both the horizontal and vertical arrays.

Yet another feature of the present invention is to provide a display and storage system which may be constructed from inexpensive materials and which employs individual display and storage devices which may be of different sizes to increase the capacity to display and store a variety of items of different sizes.

A different feature of the present invention is to provide a display and storage system which reduces store clutter and facilitates inventory management by retailers.

Another feature of the present invention is to provide a display and storage system which allows a customer to closely examine an item, make a purchase decision and then easily retrieve fresh and saleable product from the storage portion of the system.

Another feature of the present invention is to provide a display and storage system which may be mounted on peg board or other display surfaces already in use in retail establishments.

How the foregoing and other features of the invention are accomplished will be described in the following detailed description of the preferred and an alternate embodiment of the invention, taken in conjunction with the drawings. Generally, however, they are accomplished in a display and storage system which may include as few as one or a plurality of individual display and storage devices, each of which including a storage portion and a detachable display portion. The storage portion preferably includes a single vertical side and a bottom sized to hold a plurality of the items therein. When a plurality of the devices are used together, a side of a first device will act as a containment surface for the adjoining storage portion of an adjoining device. The display portion includes a cradle or other structure to support and display a single item for examination by the customer, with the item preferably being held within the cradle by a spring biased element which may also function as a handle for opening of the display portion. The display portion of each device is preferably pivotal to allow the consumer to open the display portion and remove fresh and saleable product from the storage portion once a purchasing decision has been made and also detachable to facilitate shipment of the devices. In the most preferred embodiment, the display and storage portions are each constructed from wire, and the device is tilted with respect to the vertical surface to which it is attached to create a self-closing feature for the display portion. The display portion removability is preferably accomplished using a pair of spaced apart sockets on the storage portion and spaced apart prongs on the display portion. Other ways in which the features of the invention are accomplished will become apparent to those skilled in the art after they have read the following specification, such other ways falling within the scope of the present invention if they fall within the scope of the claims which follow.

DESCRIPTION OF THE DRAWINGS

In the various FIGURES, like reference numerals are used to indicate like components.

DETAILED DESCRIPTION OF THE PREFERRED AND ALTERNATE EMBODIMENT

Before proceeding with the detailed description of the preferred and an alternate embodiments, several general comments can be made about the applicability and the scope of the present invention.

First, while photo albums are used as the illustrative product to be displayed and stored, it will soon become apparent that the display and storage system of the present invention can be used with a wide variety of products. The invention has its greatest applicability for the sale of products a consumer likes to physically inspect before making a purchasing decision, such as albums and other consumer goods. But the invention can be used with a wide variety of boxed or unboxed product. For example, an unboxed product can be displayed, while fresh and saleable boxed or wrapped product is located in a storage portion and is readily accessible for the customer once the purchasing decision is made.

Second, the display and storage device of the most preferred embodiments are prepared from wire, but other materials such as wood or plastics could be used for one or both components. For example, the display portion could be prepared from wire while the storage portion could be prepared from wood, such as particle board.

Figure 4:
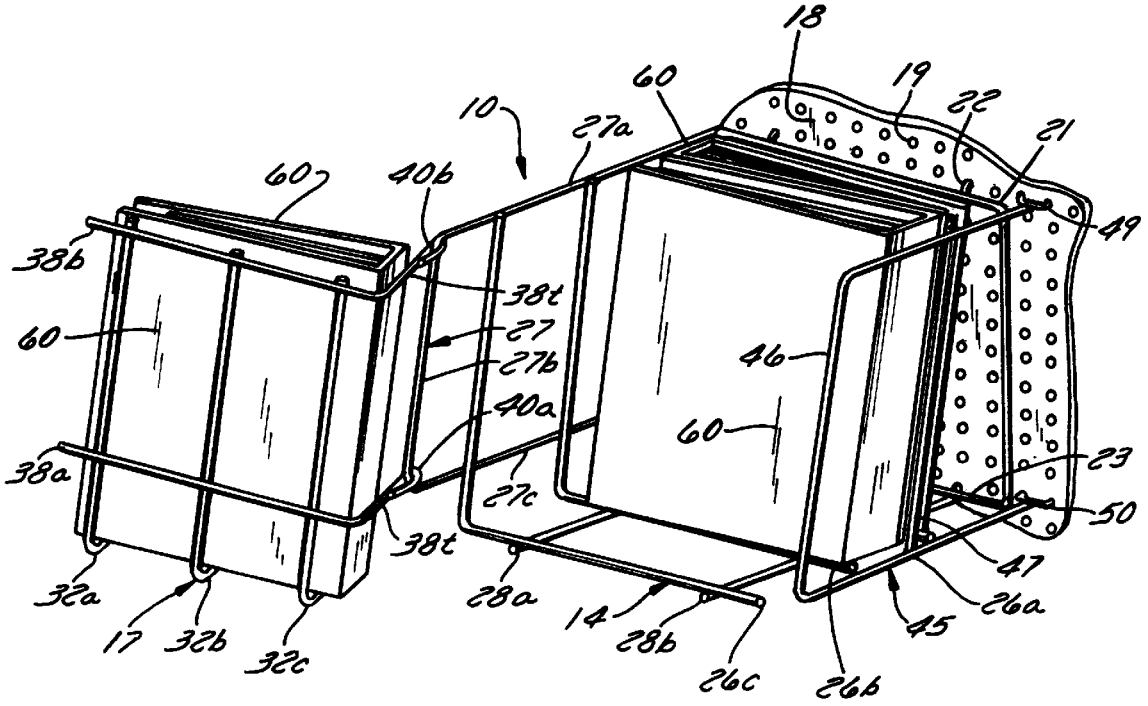
FIG. 4 is a perspective view of the display and storage devices of FIGS. 1 and 2, with product included and with the display portion open.
Figure 5:
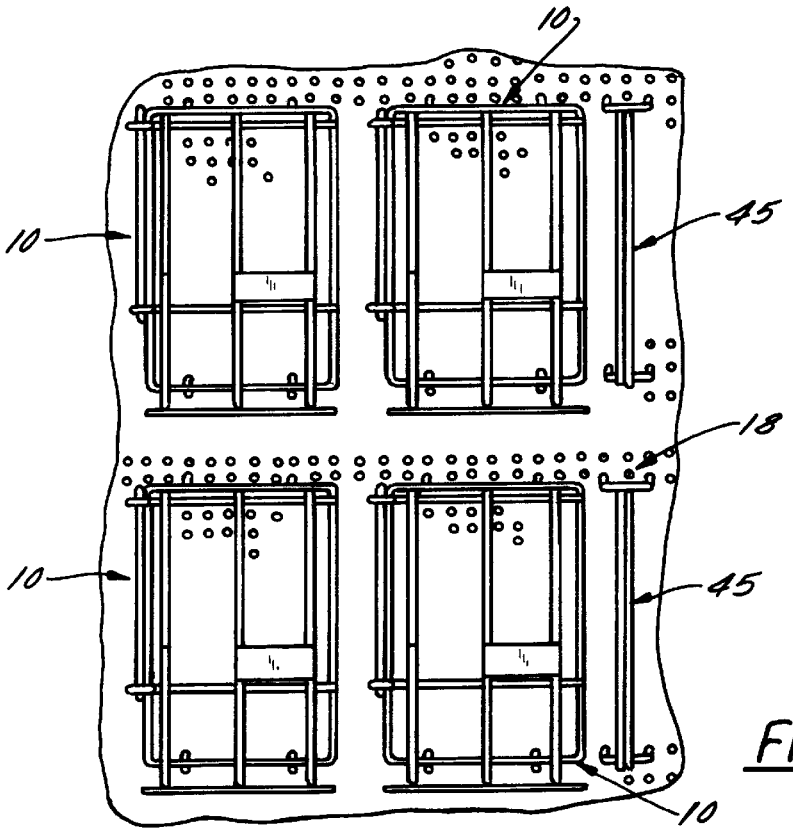
FIG. 5 is a front view of a system including four storage and display devices as shown in FIG. 1, together with a pair of wall elements for each of the two horizontal rows.

Third, the system shown in FIGS. 4 and 5 are comprised of individual display and storage devices of a common size, but a variety of different sizes could be employed to create display arrays for products of a wide variety of sizes. Each individual display device, can, itself, accommodate product of different sizes, a general rule being that the bottom should be wider than ½ the width of products. Moreover, dimensions are not critical and can be selected by the manufacturer to fit both the product and the display environment in which the product will be sold. In many retail establishments, the display and storage device should have a depth comparable to the depth of shelving to prevent the front portion of the display and storage device from extending into an aisle. Standard shelf dimensions typically are in the range of twelve to twenty inches (12"–20"), and accordingly, an overall depth for this display device in the range of twelve to twenty inches (12"–20") is most preferred.

Fourth, while the albums are stored in a horizontal position in the illustrations, product could also be stored vertically. The bottom would function like a bookshelf for photo albums, the splines of the albums facing outwardly for removal by the customer. These comments would apply to products of other shapes and sizes, as well as to photo albums.

Fifth, the preferred and alternate embodiments show respectively side and top hinging of the display portion to the storage portion. Hinging could also be accomplished from the bottom using lift and rotate systems known in the wire storage art, or the like.

Sixth, the display and storage system of the present invention is illustrated in connection with peg board display walls, but the device could easily be adapted to slat walls or other types of display surfaces without departing from its intended scope. Moreover, the illustrated embodiments show L-shaped storage portions, using a portion of an adjacent display or a separate wall element to contain product if necessary. Additional wiring could be used. For example, a U-shaped storage compartment with two side walls could be employed with the hinged display portion attached to either side or the bottom thereof.

Seventh, the particular technique for attaching the storage area to the vertical wall in the display area can be widely varied and involve techniques known in the wire closet and shelving system art, the peg board art and the like. Accordingly, the number of attachment brackets and the location thereof can be varied depending on the overall shape and size of the system components and the amount of weight which would be expected to be supported on the bottom of any individual display and storage device.

Eighth, the particular display portion shown in the first illustrated embodiment is a cradle which removably supports a photo album. The customer may remove the book entirely, open it and examine the photo album pages, the overall design, the capacity and the like and then replace the album in the cradle. Once the purchasing decision is made, the display portion is opened to allow removal of product stored behind the displayed album. In the second alternate embodiment the albums are held more securely by a spring biasing element. In photo album applications or in other applications of the present invention, it may be desirable to secure the product in the display area, so that it may be examined from the outside and from the front and back, but not removed. This additional security can be accomplished by providing a strap or chain between an internal component of the product and a component of the display portion, or by physically surrounding the displayed item by components of the display portion, such as wiring components.

Figure 1:
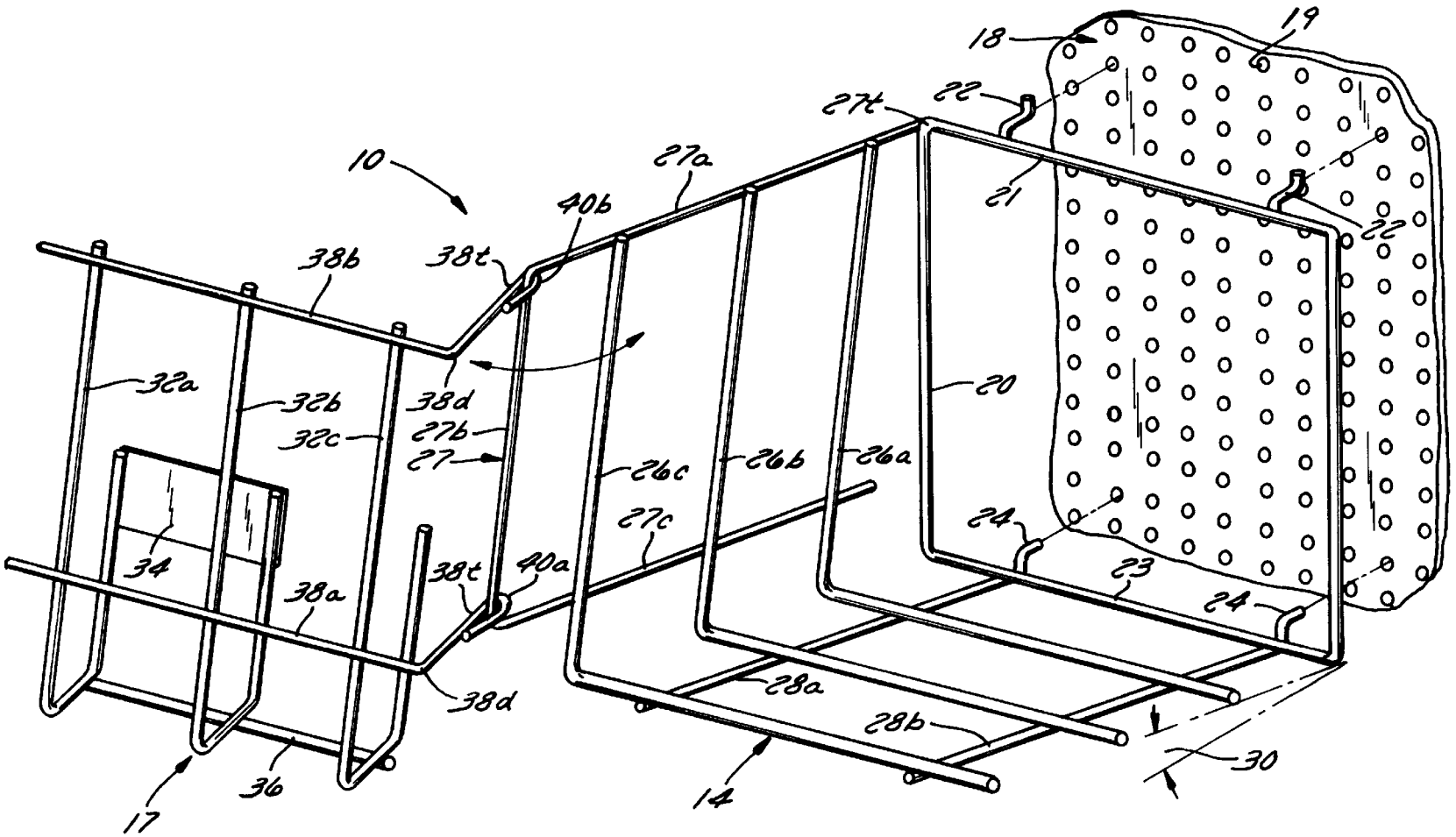
FIG. 1 is perspective view of a single display and storage device according to the most preferred form of the present invention, showing the display portion in its open position.

Proceeding now to a description of the FIGURES and the most preferred embodiment and two alternates thereof, FIG. 1 shows a display and storage device 10 having a storage portion 14 and a display portion 17, this particular FIGURE showing the display portion 17 in its open position. "Open position" as the term is used herein will mean the position which allows a customer to remove a product from storage portion 14.

The storage portion is mounted on a peg board wall 18 having a plurality of holes 19 therein. The holes may be on one inch (1") centers or other hole distributions known in the peg board art.

The rear edge of display portion 14 is defined by a rectangular frame 20 constructed out of wire rod stock. At the top side 21 of frame 20, a pair of peg board hooks 22 are located in a spaced apart relationship and adapted to engage two holes 19 of the peg board wall 18. Extending below the lower side 23 of frame 20 are a pair of pegs 24 which actually are extensions of wire rods which will be described shortly.

Storage portion 14 is shaped generally in an "L" shape when viewed from the front and is defined by a series of wire rods, each which will now be described. First, three wire rods 26*a*, 26*b*, and 26*c* which are themselves L-shaped and which are parallel to each other extend along the left side wall and bottom of storage portion 14. They are fixed in this spaced apart relationship by three wire rods 27, 28*a* and 28*b*. Wire rod 27 is a generally U-shaped and has a terminal end 27*t* coupled to the upper left hand corner of frame 20. One leg 27*a* of U-shaped wire rod 27 is welded to the top of the rods 26*a*–26*c*, and the base 27*b* of rod 27 extends outwardly from rod 26*c* by several inches, two inches (2") being preferred. The other leg 27*c* returns toward, but does not extend all the way to, frame element 20, welds being provided between leg 27*c* of rod 27 and wire rods 26*a*–26*c*.

Wire rods 26*a*–26*c* are also secured in their parallel and spaced apart relationship by a pair of bottom wire rods 28*a* and 28*b* which extend from rod 26*c* along the bottom of storage portion 14 toward peg board 18 and terminate in the aforementioned pegs 24. Rods 28*a* and 28*b* are welded to rods 26*a*–26*c* and to the bottom 23 of frames 20 to provide a strong construction for storage portion 14.

Figure 2:
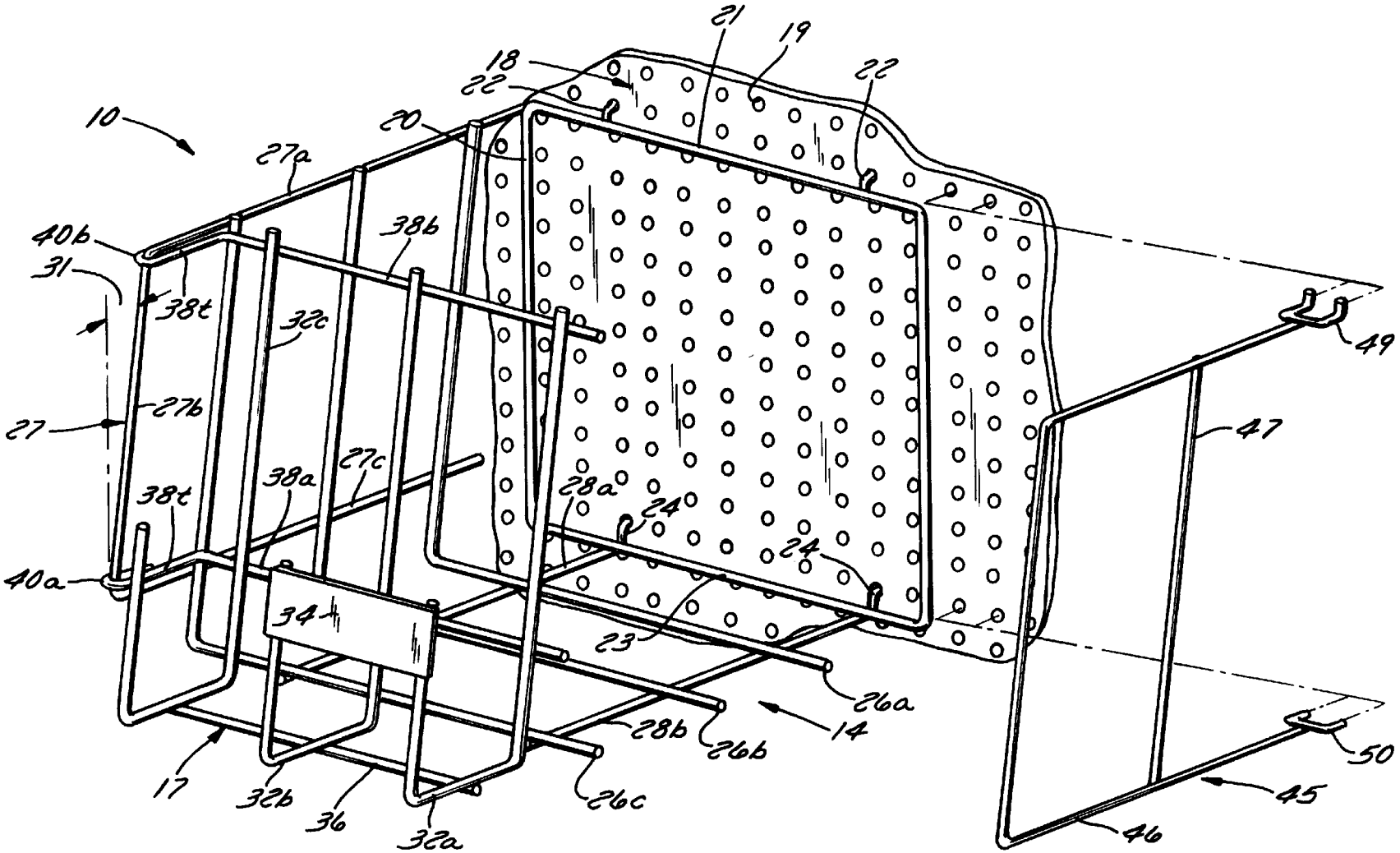
FIG. 2 is a perspective view of the device shown in FIG. 1 with the display portion in its closed position and also showing a planar wall element which may optionally be used with the device.

Display portion 17 is mounted for pivotal rotation about the bottom 27*b* of rod 27 as indicated by the arrow in FIG. 1. Reference to FIGS. 1 and 2 will be helpful in understanding display portion 17, FIG. 2 showing it in its closed position. Display portion 17 is also made from wire, including three vertical "J" shaped wire rods 32*a*, 32*b* and 32*c* which have an overall length slightly exceeding the height of rods 26*a*–26*c* in storage portion 14. Rods 32*a*–32*c* are held in their parallel and spaced apart relationship by a wire rod 36 welded to the bottom portion of the "J" of each of the rods 32*a*–32*c*, the bottom of the "J" being straight in the preferred and illustrated embodiment. Wire rods 32*a*–32*c* are also held in their parallel and spaced apart relationship by a pair of spaced apart horizontal rods 38*a* and 38*b*, each of which extends behind rods 32*a*–32*c* and are welded to them at the points of intersection. Rods 38*a* and 38*b* each include a bend 38*d* of approximately 90° and creating a short L-shaped extension 38*t* for both. The free ends of extensions 38*t* are bent into J hooks 40*a* and 40*b* which surround leg 27*b* of rod 27 of storage portion 14 to permit horizontal rotation of the display portion 17 between the two positions shown in FIGS. 1 and 2.

The storage portion 14 is preferably provided with a slight upward incline as indicated by the angle 30 in FIG. 1. With such an incline and with an object in the display portion 17, the display portion 14 will return, under the force of gravity, to the position shown in FIG. 2 after it has been opened by a customer. Another way in which this may be accomplished, and which is illustrated best in FIG. 2, is to have a slight rearward incline for leg 27*c* of rod 27. Either or both approaches may be utilized to achieve a gravitational self-closing action.

Before leaving the description of the display and storage device 10, reference can be made to FIG. 1 or 2 to note a plate 34 coupled to the upper ends of the shorter portion of wire rods 32*a* and 32*b*. Plate 34 provides a location for pricing and/or brand identification for the product to be displayed and stored.

A planar wall element 45 is shown in FIG. 2, which may be used in conjunction with display and storage devices 10. Wall element 45 is constructed from a U-shaped wire rod 46 having a cross member 47 welded thereto and terminating at its upper end in a bracket 49 having two hooks for being inserted into peg board 18 and terminating at its lower end in a bracket 50 having a pair of pegs for being inserted into adjoining horizontal holes 19. It will be appreciated by reference to further illustrations that the planar wall element 45 may be located a sufficient distance to the right of a display and storage device 10 to assist in confining product between the side wall of the storage portion 14 and the planar wall element 45. The bottom of support portion 14 should generally have a width sufficient to support objects to be displayed and stored, a general rule of thumb being that the bottom width should exceed ½ the width of the items. The planar element 45 will assist in supporting elements or product which might be stacked in such a manner that they might spill outwardly to the right, were it not for the use of planar wall elements 45.

Figure 3:
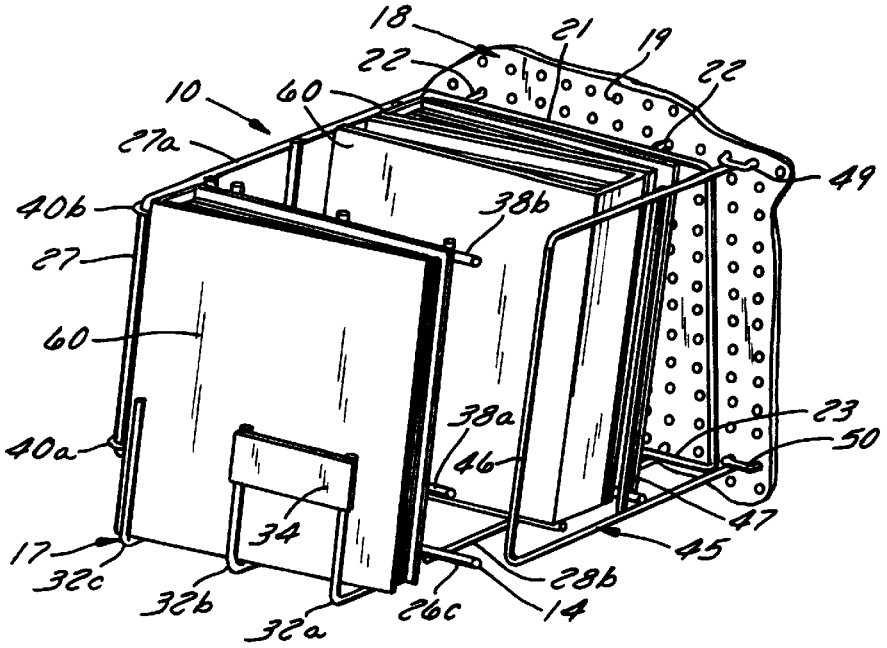
FIG. 3 is a perspective view of the display and storage devices of FIGS. 1 and 2, with product included and with the display portion closed.

FIG. 3 illustrates use of the display and storage devices 10 in conjunction with photograph albums 60. A first one of the albums is located in the display portion 17 and is supported by the flat bottoms of the J-shaped wire rods 32*a*–32*c*. Other albums 60 are located in the storage portion 14, and are confined between the side wall of portion 14 and the planar wall element 45 just described. It should also be appreciated that the items which may be inspected by the customer and which are located in display portion 17 may be removed therefrom, opened, examined and replaced at the whim of the consumer. Once a purchasing decision has been made, the display portion 17 is moved to the position shown in FIG. 4 for removal of fresh, saleable product 60 from storage portion 14. It can also be noted in these FIGURES that the construction of the hinge permits rotation of display portion 17 without interference with another, adjacent display and storage device 10.

Figure 6:
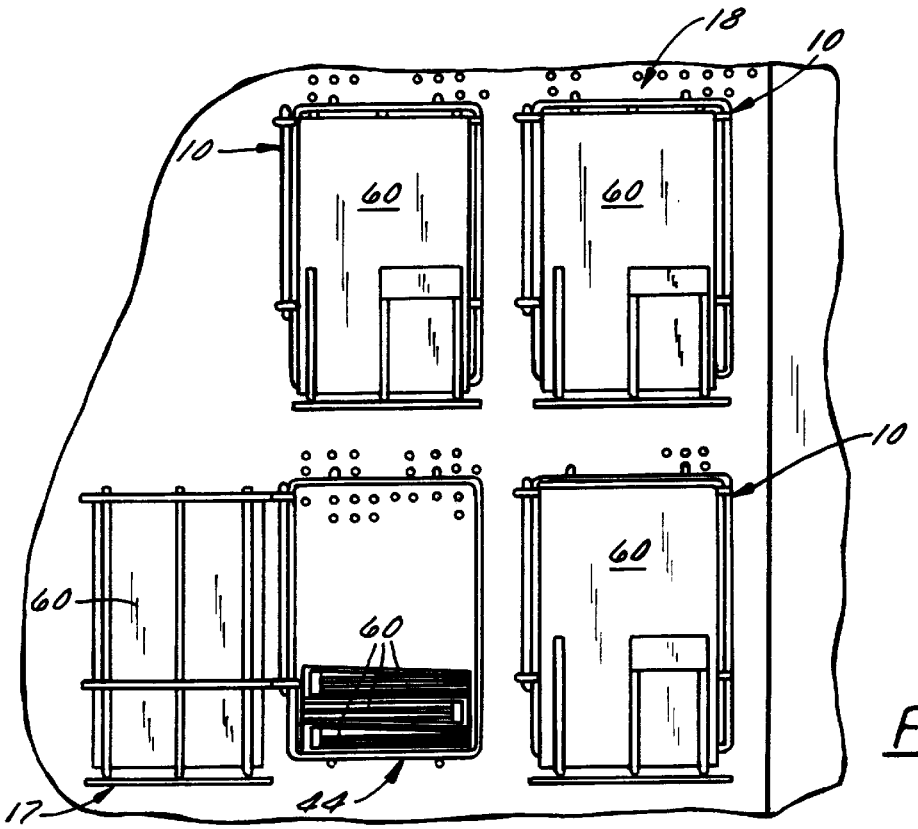
FIG. 6 is a view similar to FIG. 4 but showing photo album product in each of the four display and storage devices, with one of the four devices having its display portion open for removal of product.

FIGS. 5 and 6 show arrays of similarly sized display and storage devices 10. In the FIG. 5 illustration, all four of the display and storage devices 10 are shown in their closed position and are empty. Moreover, the four display and storage devices 10 are arranged in two rows of two devices 10, and a planar wall element 45 is shown at the right side of each horizontal row. It will be appreciated from this FIGURE that a planar wall element 45 is not required between adjoining devices 10 as the side wall of devices 10 formed by the vertical legs of rods 26*a*–26*c* will perform the same function for product held within storage portions 14. A similar view to FIG. 5 is shown in FIG. 6, but this FIGURE illustrates the opening of one display portion 17 to permit the removal of an album 60 from storage portion 14. Note also that in this FIGURE, the albums 60 are stored flat, rather than in the upstanding position illustrated in certain prior FIGURES and that planar wall elements 45 are also omitted from FIG. 6. This latter is to illustrate that if a perpendicular wall 64 adjoins peg board 18 at the appropriate location, the wall element need not be provided, as wall 64 can prevent product spillage.

Figure 7:
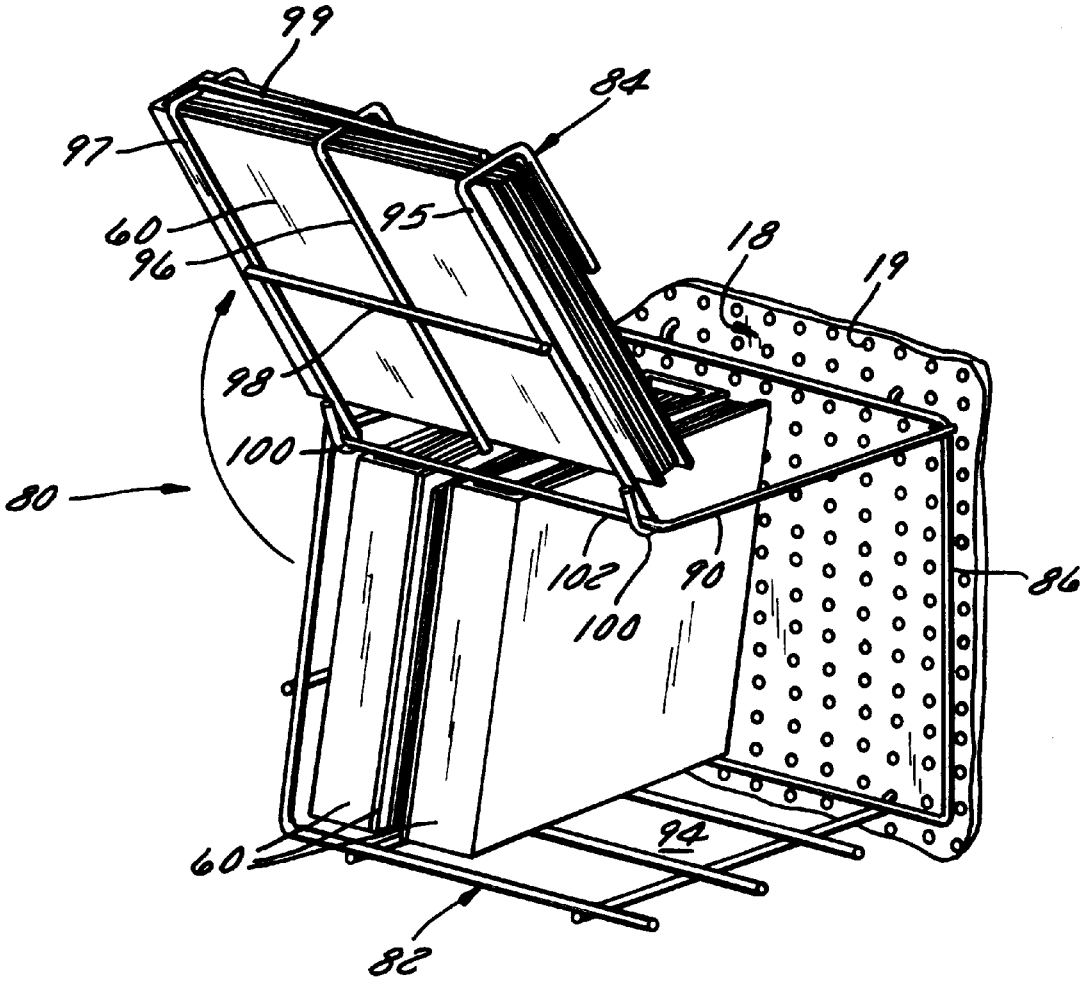
FIG. 7 is a perspective view of a first alternate embodiment of the present invention in which the display portion is hinged to a top component of the storage portion.
Figure 8:
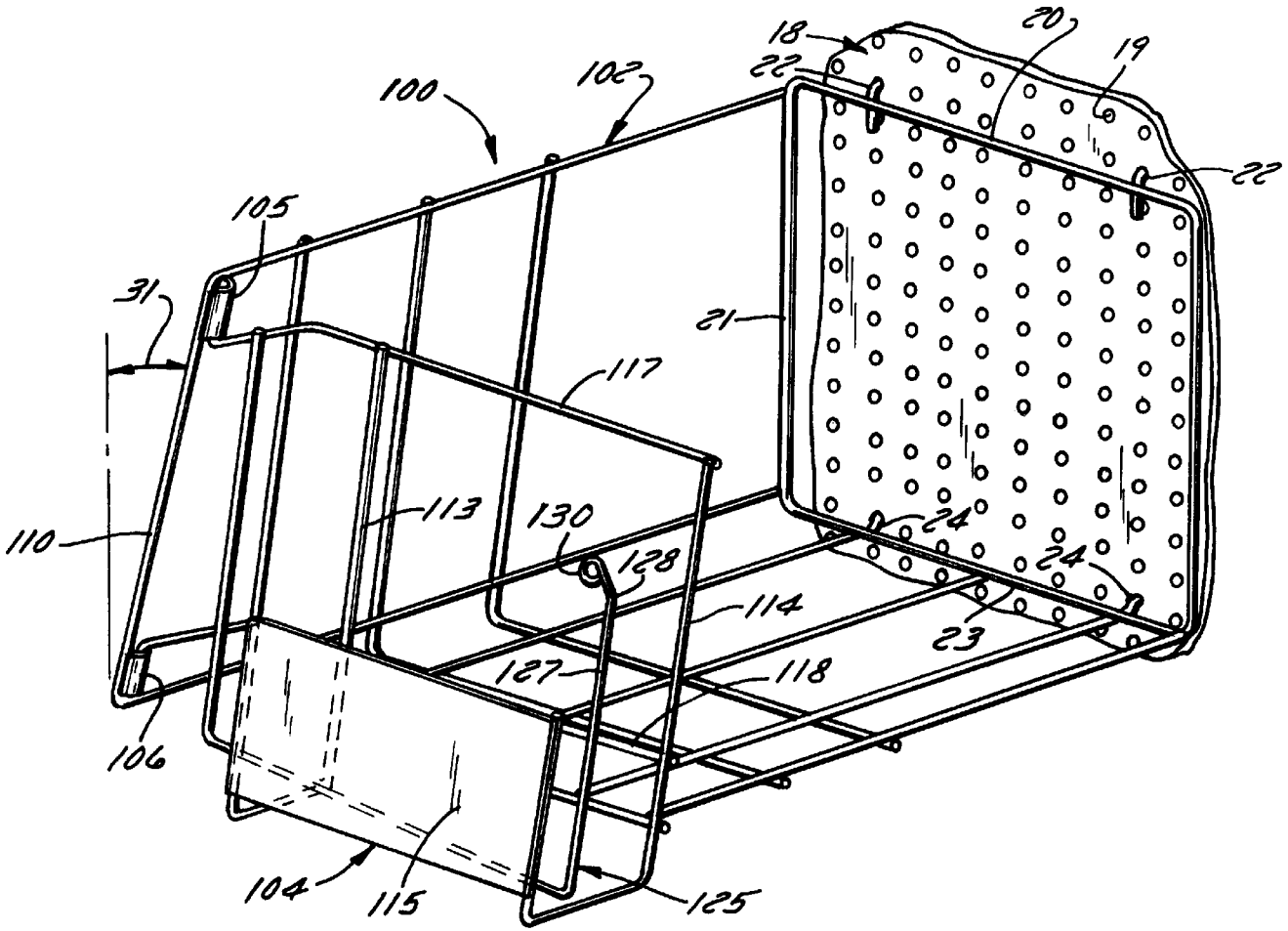
FIG. 8 is a perspective view of a second alternate embodiment of the present invention, namely one featuring a removable display portion.

A first alternate embodiment of the present invention in shown in FIG. 7, wherein a display and storage device 80 includes a storage portion 82 and a display portion 84. Some of the components are the same as in the earlier embodiment and will not be described in detail. A rectangular frame 86 is provided at the rear edge of storage portion 82, and a rectangular top frame 90 extends parallel to and above the bottom 94 of the storage portion. A peg board wall 18 is shown in this FIGURE, and the rear frame 86 is coupled thereto in the manner previously described for display and storage device 10.

The display portion 84 is modified to the extent that three J-shaped rods 95, 96 and 97 are provided, together with two short connecting rods 98 and 99. The outside rods 95 and 97 include J hooks 100 at their upper ends, the hooks 100 extending about the forward leg 102 of the upper frame 90.

This embodiment achieves open position and access to the storage portion 82 by raising the display portion 84 about a horizontal hinge axis, but otherwise functions in the manner previously described for display and storage device 10.

A second alternate embodiment of the invention is shown in FIGS. 8–11. This embodiment is similar with respect to the overall configuration of the storage portion, but differs in the way in which the display portion is attached thereto, and also in the use of a spring biasing element to more securely, but releasably, hold the article to be displayed within the display portion. The spring biasing element also functions as a handle to assist in opening of the display portion.

Proceeding now to a detailed description of the second alternate embodiment, a display and storage device 100 includes a storage portion 102 and a display portion 104. The storage portion 102 is identical in most respects to storage portion 14, with the exception that a pair of sockets 105 and 106 are provided at the upper and lower portions of the front wire 110. The sockets 105 and 106 are mounted on the rear of front wire 110. The sockets 105 and 106 each include a generally cylindrical open portion 111 and a U-shaped coupling portion 112, the latter being secured to front wire 110. When using wire components, it is preferable to weld portions 112 to the front wire 110, although a snap fit could be used if the material from which sockets 105 and 106 were made was sufficiently resistant to accidental removal. An adhesive could also be used.

Figure 9:
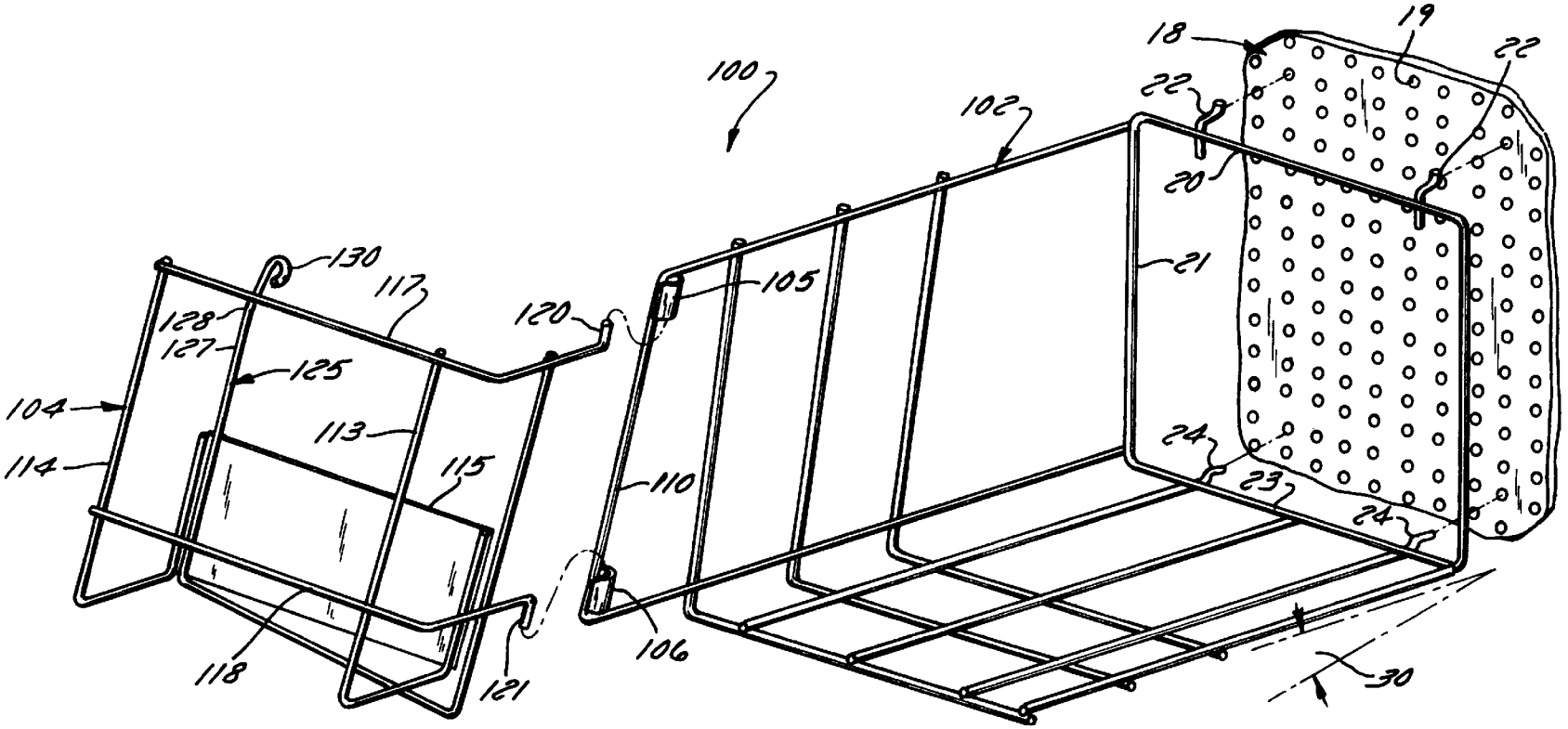
FIG. 9 is a perspective view of the separated display and storage portions of the second alternate embodiment of the present invention.
Figure 10:
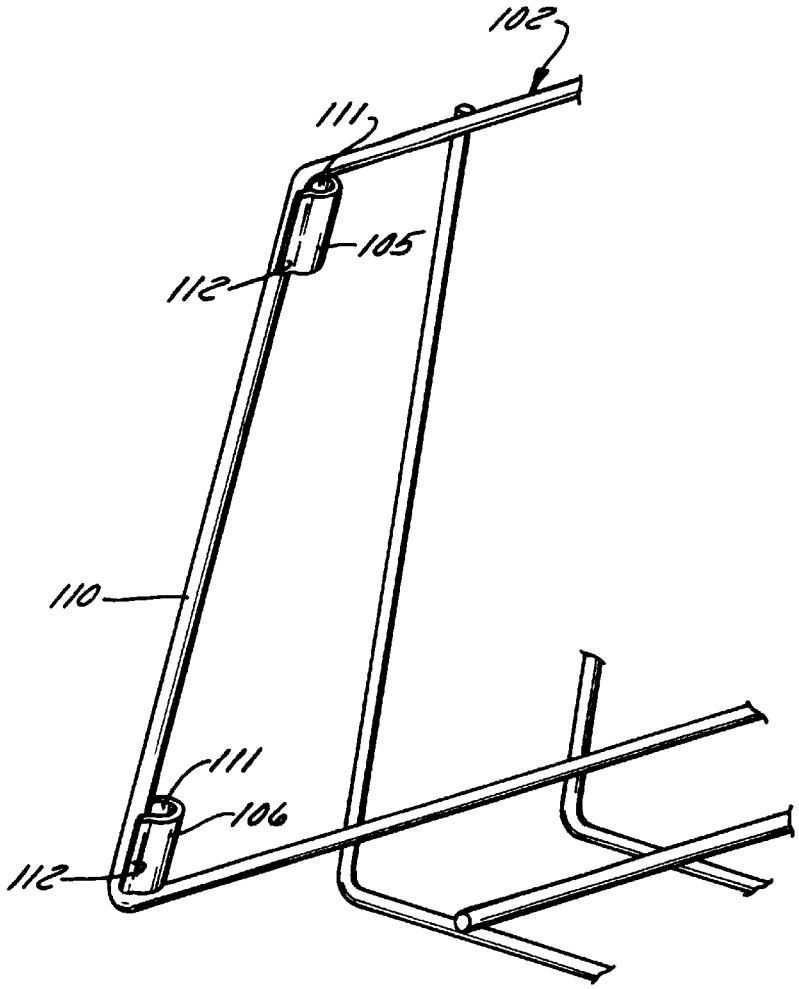
FIG. 10 is an enlarged view of the front wire of the storage portion of the second alternate embodiment of the present invention and illustrating the spaced apart sockets used for coupling of the display portion.
Figure 10A:
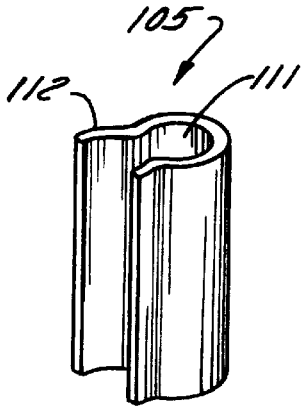
FIG. 10*a* is an enlarged view of the socket used for coupling of the display portion.
Figure 11:
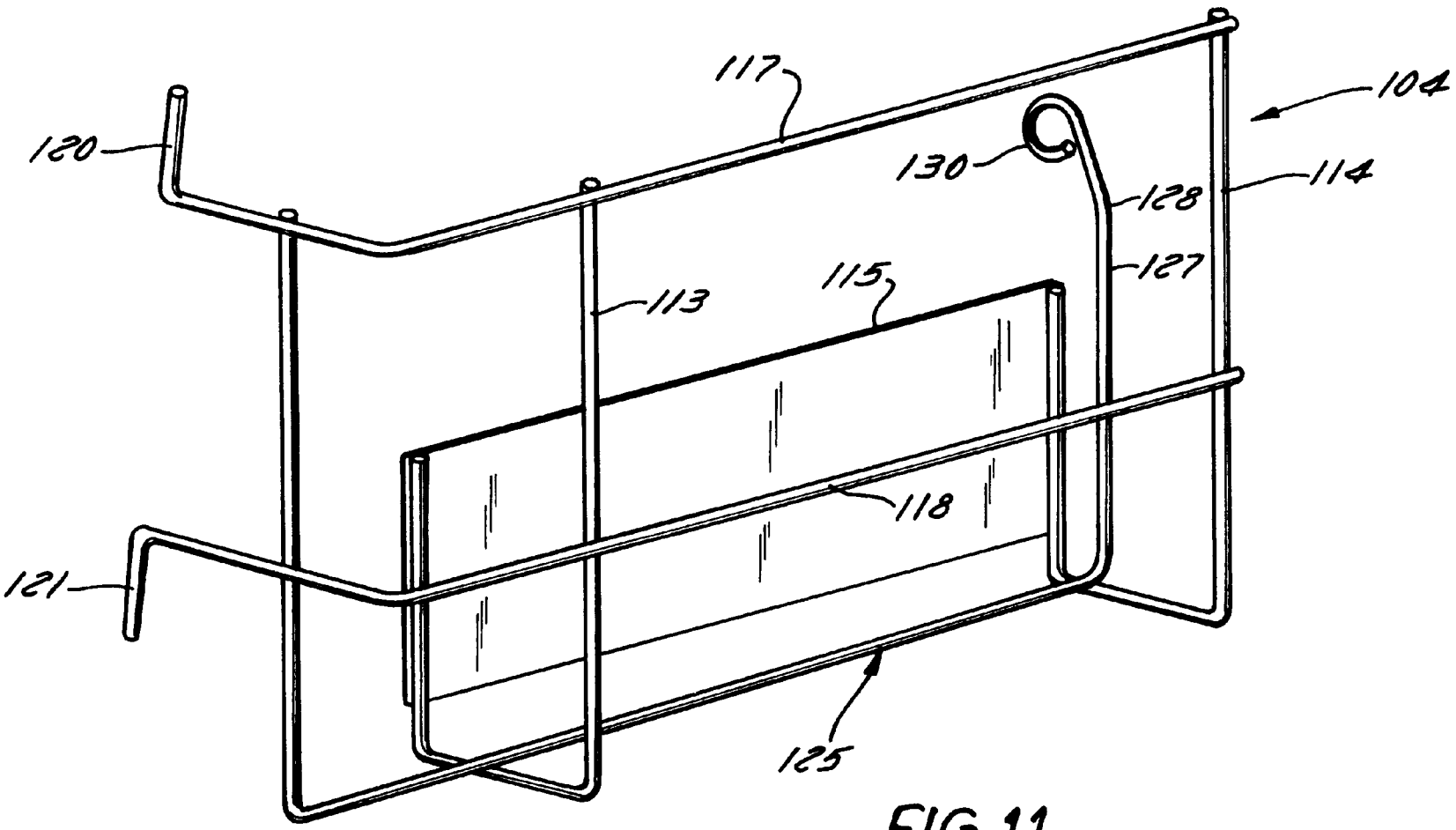
FIG. 11 is a side perspective view of the display portion of the second alternate embodiment of the present invention and illustrating the spring biasing element and the spaced apart prongs used to couple the display portion to the storage portion.

FIG. 9 shows storage portion 102 and display portion 104 positioned adjacent to one another, but disconnected. By examining FIGS. 9 and 11, it can be seen that the display portion 104 is formed from a pair of J wires 113 and 114 and that a display panel 115 is coupled to the short legs of wires 113 and 114 to form the front information display area. A pair of generally horizontal and L-shaped wires 117 and 118 are welded to wires 113 and 114 so that the short leg of the "L" extends forwardly to a location in the same general horizontal plane as the display panel 115.

Each of wires 117 and 118 are bent in a vertical direction by 90°, wire 117 being bent upwardly into a prong 120 and wire 118 being bent downwardly into a prong 121. These prongs 120, 121 and wires 117 and 118, are constructed and arranged to permit the insertion of 117 and 118 into the cylindrical portions 111 of sockets 105 and 106 to permit pivotal rotation of display portion 104 about the axis defined by portion 111. The spacing may be arranged so that the upper prong 120 is first inserted into socket 105 and the display portion 104 is then urged upwardly. At this point, prong 121 is positioned over the top of socket 106 and the display portion 104 dropped slightly so that a portion of each of prongs 120 and 121 remains in the sockets 105 and 106. An alternate arrangement would be to provide sufficient spring in wires 117 and 118 to allow a slight compression between the prongs 120 and 121 to allow display portion 104 to be placed between sockets 105 and 106, at which point the spring force would be released to allow the prongs to extend into the sockets.

Other detachable hinge arrangements could be used in lieu of the prong and socket arrangement illustrated in FIGS. 8–11. For example, an elongate U-shaped rail could be attached to a wire joining the forward portions of wires 117 and 118. Such U-shaped rail could be snapped into engagement with the front wire 110 of storage portion 102. Portion 104 would thereby rotate around the axis of the front wire 110, rather than around an axis defined by sockets 105 and 106. Various alternative detachable couplings for the display portion 104 and the storage portion 102 will appear to those skilled in the art after they appreciate this feature of the invention.

A primary advantage of having portions 102 and 104 be detachable from one another is the increased shipping density which may be obtained. The storage portions 102 can be nested for shipment, perhaps with a paper or film layer separating the individual components for protection of the painted wire rods, and a number of display portions 104 can thereafter be placed in the area defined by the side and bottom of the top storage portion 102. An increased shipping density of between 2:1 and 6:1, or more, can be achieved using this embodiment.

Another advantage of the second alternate embodiment is that if either a storage portion 102 or a display portion 104 becomes damaged, that part can be replaced without the need for replacement of the entire display and storage device 100.

A further feature of the second alternate embodiment is illustrated in FIGS. 8–11, i.e. a spring wire 125 which is used for the dual purposes of constraining a photo album (or other article) in display portion 104 and providing a readily accessible handle for use by the consumer in opening the display portion 104. The spring wire 125 is generally U-shaped and is welded to the approximate mid-point of the short legs of the L-shaped horizontal wires 117 and 118 and at about the mid-point of the J-wire 113. The free leg 127 of wire 125 is bent forwardly at near upper end (see reference number 128) and a curl 130 is provided at its upper end. This arrangement allows the user to pull outwardly on the curl 130, thereby increasing the distance from bend 128 and the back of display portion 104. The curl 130 can also be used to facilitate rotation of display portion 104 about the detachable hinge axis.

The wall unit 45, described in connection with the first embodiment, can also be used with the second alternate embodiment.

While the present invention has been described in connection with a preferred and an alternate embodiment thereof, the invention is not to be limited thereby but is to be limited solely by the scope of the claims which follow.

What is claimed is:

1. A display and storage device comprising:

an L-shaped storage portion consisting essentially of a single side, a bottom and a rear having upper and lower edges, the storage portion being open to one side and having an unobstructed top and front, the side and bottom having front edges;

a display portion having a containment area for receiving an object to be displayed and having at least a back and a bottom, the display portion being pivotally coupled to the front of the storage portion and being removable therefrom, pivotal movement of the display portion providing unobstructed access to the storage portion and removal of the display portion providing the capability of exchanging a new display portion for a damaged display portion and providing the capability of nesting a plurality of the storage portions.

2. The device of claim 1 wherein the storage portion and the display portion are each made from wire rods and the side includes a forward wire rod.

3. The device of claim 2 wherein the display portion is removably and pivotally coupled to the forward wire rod of the storage portion.

4. The device of claim 2 wherein the forward wire rod is located a greater distance from the rear of the storage portion than the front edge of the bottom.

5. The device of claim 4 wherein the forward wire rod is inclined rearwardly from its bottom to its top to provide a self-closing action for the display portion.

6. The device of claim 2 wherein the removable and pivotal coupling is provided by a pair of coaxial sockets on the storage portion and a pair of wire rod prongs on the display portion arranged to engage the sockets.

7. The device of claim 1 wherein the display portion is removably and pivotally coupled to the storage portion using a hinge.

8. The device of claim 1 wherein a spring biasing element is included in the display portion to confine, under a compressive force, the object to be displayed.

9. The device of claim 8 wherein the storage portion and the display portion are each made from wire rods.

10. The device of claim 9 wherein the spring biasing element is a wire rod.

11. The device of claim 10 wherein the spring biasing wire rod includes a curl arranged to act as a handle for pivoting the display portion relative to the storage portion.

12. The device of claim 1 further including pegboard brackets on the rear of the storage portion for attaching the system to a vertical pegboard surface.

13. The device of claim 12 wherein the bottom of the storage portion is inclined with respect to the rear so that the front edge of the bottom is higher than the lower edge of the rear of the storage portion and the side front edge is inclined rearwardly from its bottom to its top to provide a self-closing action for the display portion.

14. A storage and display system including a vertical surface and a plurality of storage and display devices each of which comprises:

an L-shaped storage portion consisting essentially of a single side, a bottom and a rear having upper and lower edges, the storage portion being open to one side and having an unobstructed top and front, the side and bottom having front edges;

a display portion having a containment area for receiving an object to be displayed and having at least a back and a bottom, the display portion being pivotally coupled to the front of the storage portion and being removable therefrom, pivotal movement of the display portion providing unobstructed access to the storage portion and removal of the display portion providing the capability of exchanging a new display portion for a damaged display portion and providing the capability of nesting a plurality of the storage portions;

the rear of each of the devices being coupled to the vertical surface and at least two of the devices being arranged in a horizontal line, but spaced apart from one another, so that the side of one device assists in confining objects placed in the storage portion of an adjacent device.

15. The system of claim 14 wherein the storage portion and the display portion are each made from wire rods and the side includes a forward wire rod.

16. The system of claim 15 wherein the display portion is removably and pivotally coupled to the forward wire rod of the storage portion.

17. The system of claim 15 wherein the removable and pivotal coupling is provided by a pair of coaxial sockets on the storage portion and a pair of wire rod prongs on the display portion adapted to engage the sockets.

18. The system of claim 14 wherein the display portion is removably and pivotally coupled to the storage portion using a hinge.

19. The system of claim 14 wherein a spring biasing element in the display portion confines the object to be displayed under a compressive force.

20. The system of claim 19 wherein the storage portion and the display portion are each made from wire rods.

21. The system of claim 20 wherein the spring biasing element is a wire rod.

22. A method of packaging a plurality of storage and display devices each of which comprises:

an L-shaped storage portion consisting essentially of a single side, a bottom and a rear having upper and lower edges, the storage portion being open to one side and having an unobstructed top and front, the side and bottom having front edges;

a display portion having a containment area for receiving an object to be displayed and having at least a back and a bottom, the display portion being removably and pivotally coupled to the front of the storage portion, pivotal movement of the display portion providing unobstructed access to the storage portion and removal of the display portion providing the capability of exchanging a new display portion for a damaged display portion and providing the capability of nesting a plurality of the storage portions, the method comprising the steps of:

a) removing the display portion from each device;

b) nesting the plurality of storage portions;

c) placing the plurality of display portions in the area defined by the uppermost storage portion; and d) placing the nested, separated portions in a package.

23. The method of claim 22 where the storage and display portions are made from wire rods and a protective sheet is located between each nested component.

* * * * *